US010280649B2

(12) United States Patent
Li

(10) Patent No.: US 10,280,649 B2
(45) Date of Patent: May 7, 2019

(54) MAGNETIC UNLOCKING DEVICE AND MAGNETIC UNLOCKING STRUCTURE OF MAGNETIC ENCODING KEY

(71) Applicant: Xin Li, Zhuhai (CN)

(72) Inventor: Xin Li, Zhuhai (CN)

(73) Assignee: ZHUHAI PERFECTION TECHNOLOGY CO., LTD, Zhuhai (CN)

( * ) Notice: Subject to any disclaimer, the term of this patent is extended or adjusted under 35 U.S.C. 154(b) by 141 days.

(21) Appl. No.: 15/313,108

(22) PCT Filed: Apr. 20, 2015

(86) PCT No.: PCT/CN2015/000276
§ 371 (c)(1),
(2) Date: Nov. 22, 2016

(87) PCT Pub. No.: WO2015/176540
PCT Pub. Date: Nov. 26, 2015

(65) Prior Publication Data

US 2017/0138090 A1 May 18, 2017

(30) Foreign Application Priority Data

May 22, 2014 (CN) ..... 2014 1 0218163

(51) Int. Cl.
*E05B 47/00* (2006.01)
*E05B 19/00* (2006.01)
(Continued)

(52) U.S. Cl.
CPC ..... *E05B 47/0045* (2013.01); *E05B 19/0047* (2013.01); *E05B 19/26* (2013.01);
(Continued)

(58) Field of Classification Search
CPC .. E05B 19/00; E05B 19/0017; E05B 19/0047; E05B 19/26; E05B 47/0038;
(Continued)

(56) References Cited

U.S. PATENT DOCUMENTS 3,234,767 A 2/1966 Claes
3,416,336 A * 12/1968 Felson ..... E05B 47/0044 70/276
(Continued)

FOREIGN PATENT DOCUMENTS

CN 101638949 A 2/2010
CN 201447943 U 5/2010
(Continued)

*Primary Examiner* — Christopher J Boswell
(74) *Attorney, Agent, or Firm* — Gokalp Bayramoglu

(57) ABSTRACT

A magnetic unlocking device and a magnetic unlocking structure of a magnetic encoding key. The magnetic unlocking structure includes a lock core device and a magnetic unlocking device. The lock core device includes a lock core casing, a lock knob which is provided in the internal cavity of the lock core casing, a lock care front end cover and a lock core rear end cover that are located at both ends of the lock core casing. The internal wall of the lock core casing is provided with a monad longitudinal moving groove and a monad horizontal rotating groove. The lock knob is provided with an unlocking hole. The external wall of the lock knob is provided with a monad longitudinal slide-way. The monad longitudinal slide-way and the monad longitudinal moving groove correspond to each other and form a monad moving cavity.

9 Claims, 6 Drawing Sheets

(51) Int. Cl.
*E05B 73/00* (2006.01)
*E05B 19/26* (2006.01)

(52) U.S. Cl.
CPC ..... *E05B 47/0038* (2013.01); *E05B 47/0044* (2013.01); *E05B 73/0052* (2013.01)

(58) Field of Classification Search
CPC ..... E05B 47/0043; E05B 47/0044; E05B 47/0045; E05B 73/0052
See application file for complete search history.

(56) References Cited

U.S. PATENT DOCUMENTS 3,942,345 A 3/1976 Sasahara
4,228,667 A 10/1980 Herriott
4,287,733 A * 9/1981 Gomez-Olea ..... G07C 9/00738 70/276
4,380,162 A * 4/1983 Woolfson ..... E05B 47/0044 70/276
4,562,711 A * 1/1986 Fliege ..... G07C 9/00738 70/276
4,748,834 A * 6/1988 Herriott ..... E05B 47/0038 335/306
4,841,758 A * 6/1989 Ramblier ..... E05B 47/0044 70/276
6,705,139 B2 * 3/2004 Tsai ..... E05B 47/0044 70/276
9,790,712 B2 * 10/2017 Li ..... E05B 47/0044
2014/0250959 A1 * 9/2014 Tsai ..... E05B 47/0044 70/491

FOREIGN PATENT DOCUMENTS

CN 102003111 A 4/2011
CN 201972462 U 9/2011
CN 202081725 U 12/2011
CN 202990621 U 6/2013
CN 10393831 A 7/2014
CN 104005606 A 8/2014
CN 203924995 U 11/2014
DE 2539757 A1 3/1977
DE 2727126 A1 12/1978
DE 4041094 A1 6/1992
JP H1-73264 5/1989

* cited by examiner

MAGNETIC UNLOCKING DEVICE AND MAGNETIC UNLOCKING STRUCTURE OF MAGNETIC ENCODING KEY

CROSS REFERENCE TO RELATED APPLICATIONS

This application is the national phase of International Application No. PCT/CN2015/000276, filed on 20 Apr. 2015, which is based upon and claims priority to Chinese Patent Application No. 201410218163.7, filed on May 22, 2014, the entire contents of which are incorporated herein by reference.

TECHNICAL FIELD

The present invention relates to a magnetic unlocking device and a magnetic unlocking structure of a. magnetic encoding key.

BACKGROUND

In the industries (such as the electricity, the petrochemistry, the transportation, the metallurgy, the coal and so on), it is a common method of equipment management to lock the door of the equipment and the manual operating mechanism using the lockset. Using a key to operate the lockset is a common method of equipment management, and security arrangement which is essential to avoid accidental risk. Nowadays, the lockset for locking is the ordinary lockset available in the market primarily. Such kind of lockset usually encompasses the lock core with the structure of "bullet-spring" or "bland". Such structure has significant defects if applied in industries. The defects are mainly reflected in terms of reliability. (a) Due to the incomplete rain-proof structure, the parts of the lock core are easily prone to rust. Such phenomenon is especially observed in the oceanic climate, acid rain climate, or the environment which may induce an electrochemical reaction. (b) Since the unlocking hole does not have the dustproof structure, under the condition of a sandstorm, the dust can enter the lock core through the unlocking hole easily, which makes it impossible to open the lock. With respect to this problem, people tried to develop new lockset structure to deal with the above defects. For example, the intention patent whose number is ZL201410107543.3 filed by the present applicant previously and which is titled as a lock core structure with a magnetic encoding free monad style. As shown in FIG. 1, the lock core structure includes lock core casing 101, lock knob 104 which is rotatably provided in the internal cavity of lock core casing 101, lock core front end cover 102 and lock core rear end cover 103 that are located at both ends of lock core casing 101. The internal wall of the lock core casing 101 is provided with at least one monad longitudinal moving groove and at least one monad horizontal rotating groove. The end that corresponds to lock core front end cover 102 along the axis line on the lock knob 104 is provided with the unlocking hole of the magnetic encoding key. The external wall of the lock knob 104 is provided with a plurality of monad longitudinal slide-ways 112. At least one of the plurality of monad longitudinal slide-ways 112 is provided with a free monad. The free monad is big monad 107 and small monad 108. The monad longitudinal slide-ways 112 and the monad longitudinal moving groove corresponds to each other and form a monad moving cavity. When the lock core is in the locking position, at least one big monad 107 is located at a position where the monad moving cavity and the monad horizontal rotating groove stagger with each other, or at least one small monad 108 is partially located in monad longitudinal slide-ways 112. When the lock core is in the unlocking position, the big monad 107 is located at a position where the monad moving cavity and the monad horizontal rotating groove intersect, and small monad 108 is located entirely in monad longitudinal slide-ways 112. The magnetic encoding lock core designed with this structure has the advantages of good security, high reliability, easy digital management, simple structure and process of manufacture, and low cost of production. Conditions of being applied in industries are satisfied. The magnetic encoding key in the prior art cannot open the above lock core structure, which puts forward a higher requirement for the core part of the magnetic encoding key —the magnetic unlocking device.

SUMMARY

The purpose of the present invention is to provide a magnetic unlocking device and a magnetic unlocking structure of a magnetic encoding key, which has good security, high reliability, easy digital management, simple structure and process of manufacture, and low cost of production.

The technical solution of the magnetic unlocking device of a magnetic encoding key of the present invention is as follows. The magnetic unlocking device includes a key casing, at least one set of magnetic combination unit and a filler which is located inside the key casing. The magnetic combination unit includes at least one double-pole permanent magnet and magnetic yoke. One magnetic pole of the double-pole permanent magnet is near to the magnetic yoke, while the other magnetic pole is far from the magnetic yoke. A butterfly-like magnetic field distribution is generated on the external main magnetic circuit of the magnetic combination unit.

Furthermore, the magnetic combination unit includes a plurality of double-pole permanent magnets. Surface magnetic fluxes of a plurality of double-pole permanent magnets increase or decrease along the arranging orientation. Two adjacent double-pole permanents magnet on the same side have opposite polarities. The magnetic yoke is used as a magnetic conducting path for perspective magnetic pole of the plurality of double-pole permanent magnets oriented to an axial center. The main magnetic circuit passing therethrough. A magnetic field distribution which is weak-to-strong or strong-to-weak along a magnet arranging orientation is generated on the external main magnetic circuit of the magnetic combination unit.

Furthermore, there are a plurality sets of magnetic combination units. Some of the magnetic combination units include a single double-pole permanent magnet and magnetic yoke. Remaining magnetic combination units include a plurality of the double-pole permanent magnets and magnetic yoke. The plurality sets of magnetic combination units share the same magnetic yoke.

Furthermore, the magnetic yoke is one of soft iron or magnetic steel or magnetically soft alloy or ferrite material.

Furthermore, the filler is a magnetic conductor or a magnetic non-conductor.

The technical solution of another magnetic unlocking device of a magnetic encoding key of the. present invention is as follows. The magnetic unlocking device includes a key casing, at least one set of magnetic combination unit and tiller which is located inside the key casing. The magnetic combination unit includes the multi-pole permanent magnet and the magnetic yoke. The multi-pole permanent magnet is divided into a plurality of magnet units that have opposite polarities. Surface magnetic fluxes of the plurality of the magnet units increase or decrease one by one along the arranging orientation. Adjacent magnet units on the same side have opposite polarities. The magnetic yoke is used as a magnetic conducting path for perspective magnetic pole of the plurality of the multi-pole permanent magnet oriented to an axial center. The main magnetic circuit passes therethrough. A magnetic field distribution which is weak-to-strong or strong-to-weak along a magnet arranging orientation is generated on the external main magnetic circuit of the magnetic combination unit.

Furthermore, there are a plurality sets of magnetic combination unit. The plurality sets of magnetic combination units share the same magnetic yoke.

The technical solution of a magnetic unlocking structure of the present invention is as follows. The magnetic unlocking structure includes a lock core device and a magnetic unlocking device which fits the lock core device. The magnetic unlocking device includes key casing, at least one set of magnetic combination unit and filler which is located inside the key casing. The magnetic unlocking device is inserted into and fit the lock core device. The magnetic combination unit includes magnetic yoke and one double-pole permanent magnet or a plurality of double-pole permanent magnets or multi-level permanent magnet. The lock core device includes a lock core casing, a lock knob which is rotatably provided in the internal cavity of the lock core casing, a lock core front end cover and a lock core rear end cover that are located at both ends of the lock core casing. The internal wall of the lock core casing is provided with at least one monad longitudinal moving groove and at least one monad horizontal rotating groove. An end of the lock knob corresponding to the lock core front end cover along an axis line is provided with an unlocking hole of the magnetic encoding key. The external wall of the lock knob is provided with a plurality of monad longitudinal slide-ways. At least one of the plurality of monad longitudinal slide-ways being provided with a free monad. The free monad being big monad and/or small, monad. The monad longitudinal slide-ways and the monad longitudinal moving groove correspond to each other and form a monad moving cavity. When unlocking, the magnetic combination unit and each free monad moving cavity correspond to each other in terms of positions. The main magnetic field of the magnetic combination unit is distributed externally and directly oriented to the free monad moving cavity. An arranging direction of a magnetic field in the magnetic combination unit is the same as a moving direction of the free monad of the free monad moving cavity. The magnetic combination unit can attract one or more free monads that are located at a weak magnetic field side of the magnetic combination unit to a position which has a shortest magnetic circuit to the magnetic combination unit and a strongest magnetic field.

The advantages of the present invention are as below. 1. In the magnetic combination unit designed according to the above points, the main magnetic field distribution has a strong directivity. No matter in the mechanism or in the external space, the main magnetic field distribution is concentrated and converged. Thus, the issue of the mutual effect between the magnetic combination unit and the magnetic combination unit due to the overlapping of main magnetic fields is easy to be solved. More magnetic combination units can be positioned in the magnetic unlocking device, which enlarges the encodable number of the magnetic encoding lock core and the magnetic encoding key (the number of key bitting). Thus, the security and reliability of encoding the lock core and the magnetic encoding key are further increased; 2. The magnetic combination unit uses a design of the modular structure. Types of the magnetic combination unit are limited. The arranging position of the magnetic combination unit. is relatively fixed. Thus, before the key is assembled, the magnetic combination unit can be produced in advance. When the key is assembled, certain types of magnetic combination unit are positioned at corresponding locations according to different lock codes. Therefore, the efficiency of production of the key increases significantly. Further, the magnetic encoding key designed and produced according to the present invention has advantages of easy digital management, simple structure and process of manufacture, and low cost of production.

DETAILED DESCRIPTION

Figure 1:
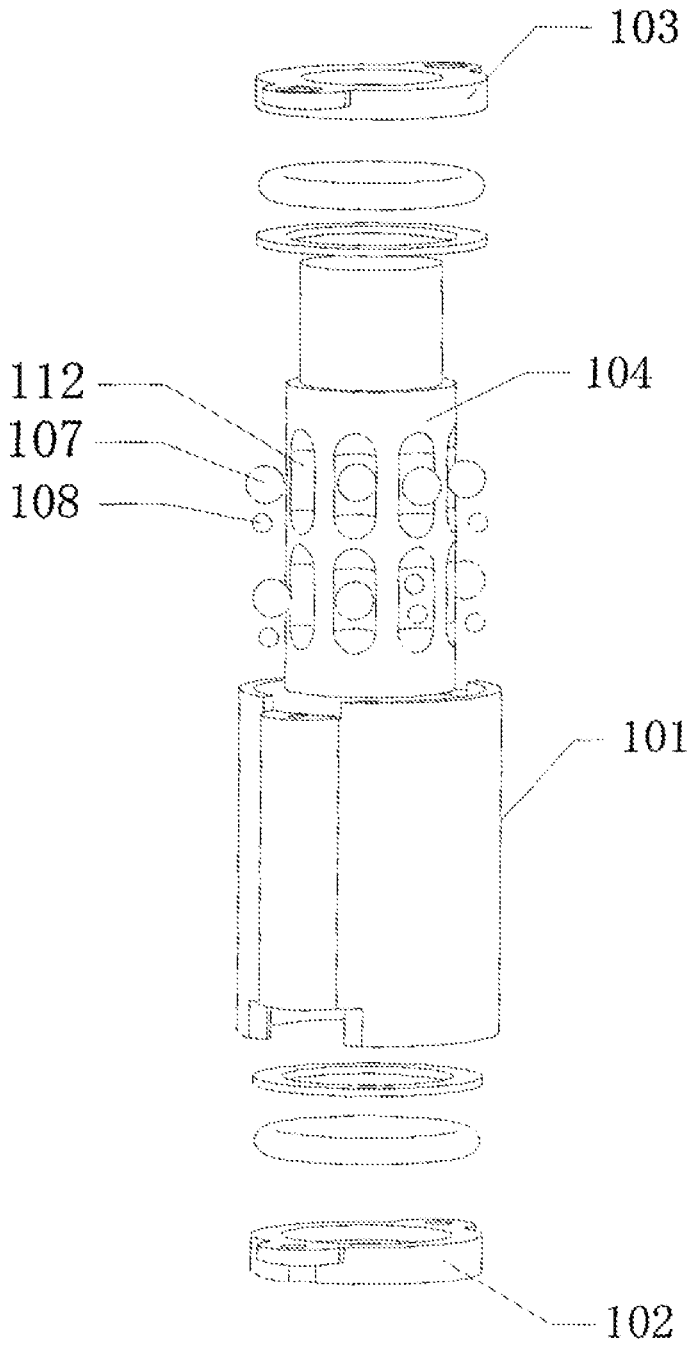
FIG. 1 is the schematic diagram of the structure of the magnetic encoding lock core device in the prior art.
Figure 2:
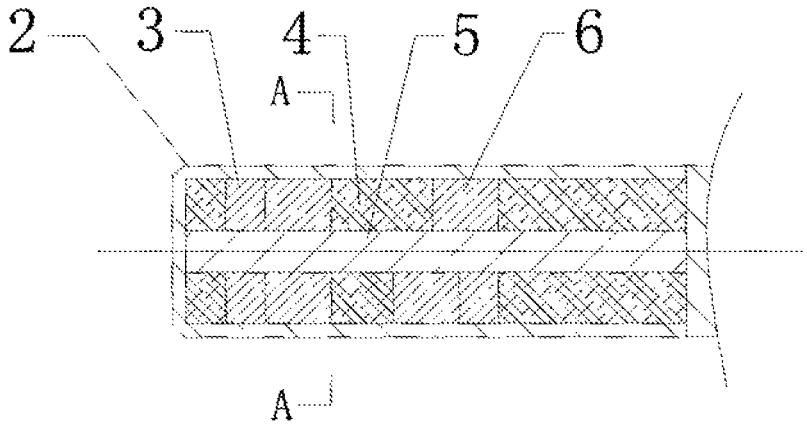
FIG. 2 is the sectional schematic diagram of the magnetic unlocking device of the present invention.
Figure 3:
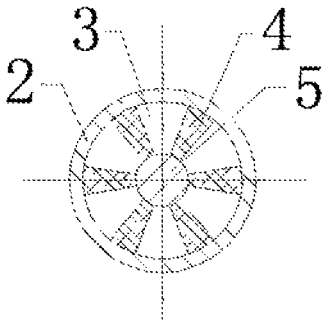
FIG. 3 is the sectional schematic diagram along A-A in FIG. 2.
Figure 4:
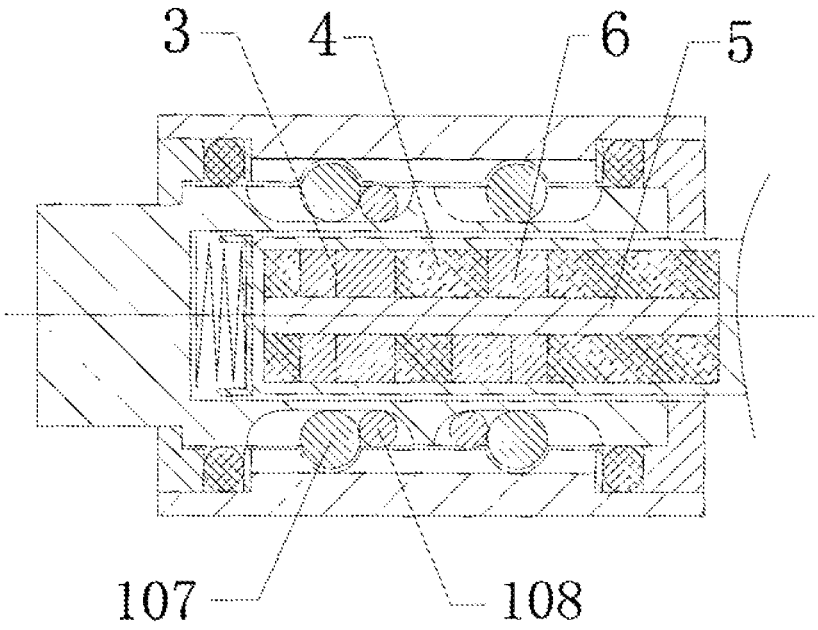
FIG. 4 is the sectional schematic diagram of the unlocking position of the magnetic unlocking mechanism of the present invention.
Figure 5:
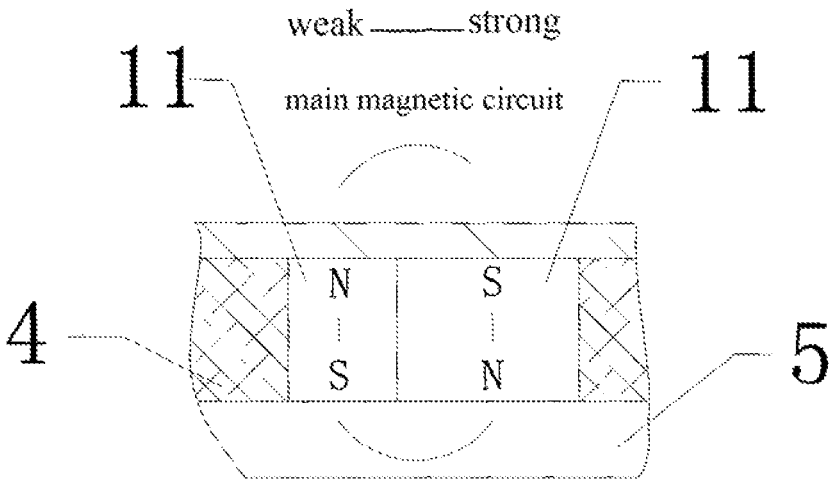
FIG. 5 is the sectional schematic diagram I of the magnetic combination unit of the present invention which is composed of the four-pole permanent magnet.
Figure 6:
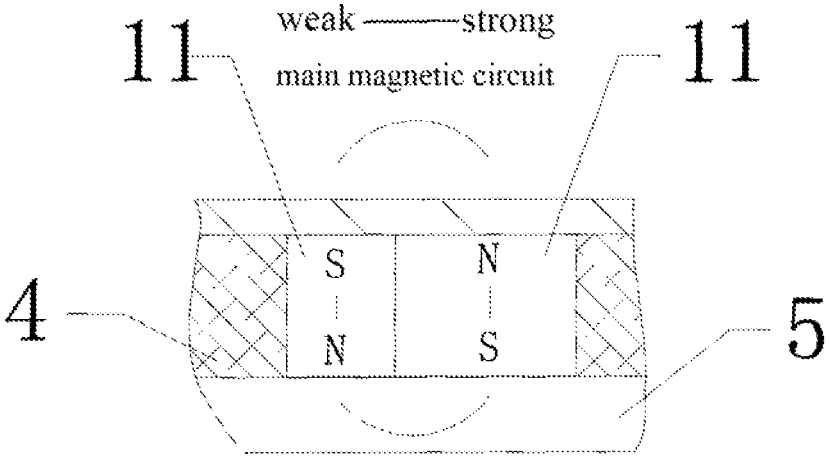
FIG. 6 is the sectional schematic diagram H of the magnetic combination unit of the present invention which is composed of the four-pole permanent magnet.
Figure 7:
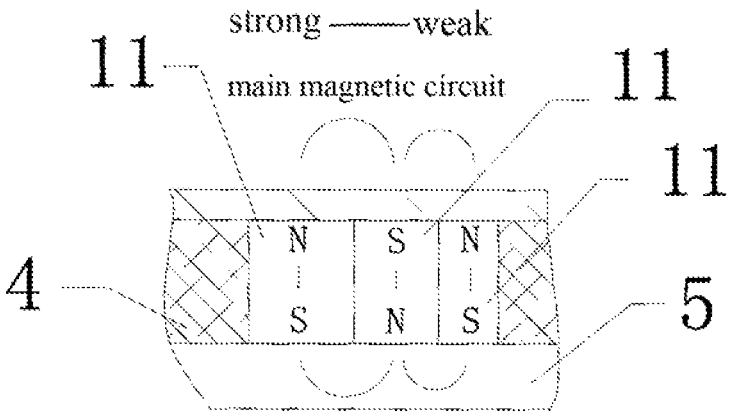
FIG. 7 is the sectional schematic diagram I of the magnetic combination unit of the present invention which is composed of the six-pole permanent magnet.
Figure 8:
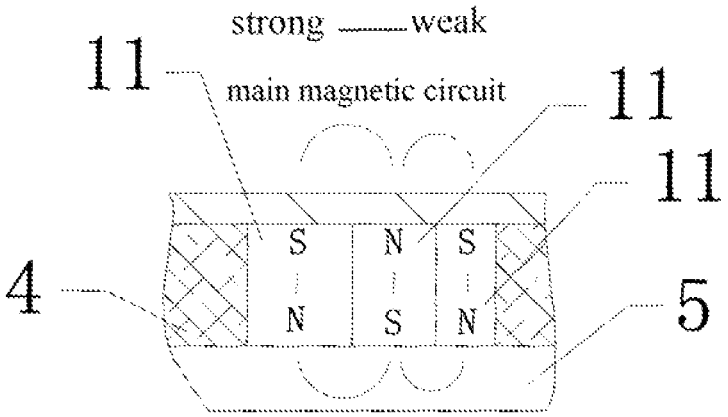
FIG. 8 is the sectional schematic diagram II of the magnetic combination unit of the present invention which is composed of the six-pole permanent magnet.
Figure 9:
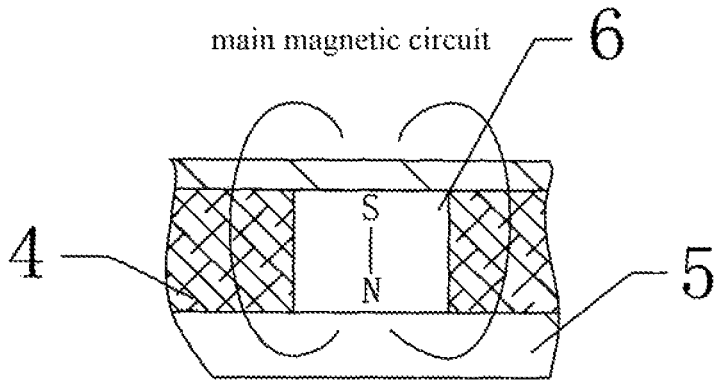
FIG. 9 is the sectional schematic diagram I the magnetic combination unit of the present invention which is composed of the double-pole permanent magnet.
Figure 10:
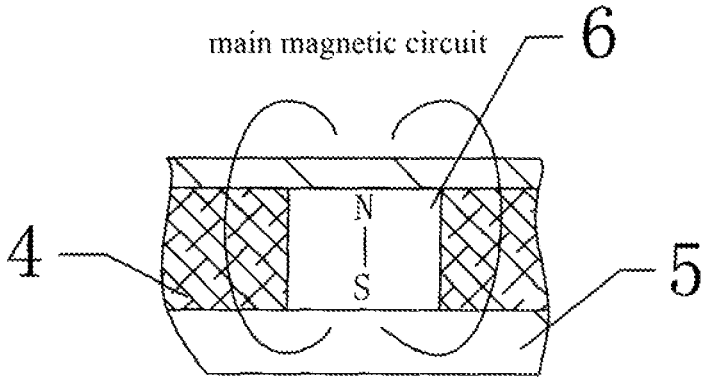
FIG. 10 is the sectional schematic diagram II of the magnetic combination unit of the present invention which is composed of the double-pole permanent magnet.

As shown in FIG. 2, FIG. 3, FIG. 4, FIG. 5, FIG. 6, FIG. 7, FIG. 8, FIG. 9, and FIG. 10, the magnetic unlocking structure of the present invention includes a lock core device and a magnetic unlocking device which is inserted into and fits the lock core device. The lock core device includes a lock core casing, a lock knob which is rotatably provided in the lock core casing internal cavity, a lock core front end cover and a lock core rear end cover that are located on both ends of the lock core casing. The internal wall of the lock core casing is provided with at least one monad longitudinal moving groove and at least one monad horizontal rotating groove. The end which corresponds to the lock core front end cover along the axis line on the lock knob is provided with an unlocking hole of the magnetic encoding key. The external wall of the lock knob is provided with a plurality of monad longitudinal slide-ways. At least one of the plurality of monad longitudinal slide-ways is provided with a. free monad. The free monad is the big monad and/or small monad. The monad longitudinal slide-way and the monad longitudinal moving groove correspond to each other and form a monad moving cavity. When the lock core is in a locking position, at least one big monad is located at a position where the monad moving cavity and the monad horizontal rotating groove stagger with each other, or at least one small monad is partially located inside the monad longitudinal slide-way. When the lock core is in an unlocking position, the big monad is located at a position where the monad moving cavity and the monad horizontal rotating groove intersect, and the small monad is entirely located inside the monad longitudinal slide-way. The magnetic unlocking device includes key casing 2 and at least one set of magnetic combination unit and filler 4 that is located inside key casing 2. The shape of the key casing 2 can be round, rectangular, triangular, etc., which is mainly determined by the structure of the preserved unlocking hole in the lock core. Preferably, the round shape is used. Filler 4 is a magnetic conductor or a magnetic non-conductor. Here, filler 4 has the function of supporting and position-limiting. Filler 4 can be molded together with casing 2 of the structure or other parts. The number of the magnetic combination unit is determined according to the number of free monad moving cavity in the lock core. There are different types of the magnetic combination unit. More accurately, there are three types of the structure. 1. The magnetic combination unit includes one double-pole permanent magnet 6 and magnetic yoke 5. At least one magnetic pole of double-pole permanent magnet 6 is near to magnetic yoke 5. The other magnetic pole is far from magnetic yoke 5. A butterfly-like magnetic field distribution is generated on the external main magnetic circuit of the magnetic combination unit. 2, The magnetic combination unit includes a plurality of double-pole permanent magnets 6. The surface magnetic fluxes of the plurality of double-pole permanent magnets 6 increase or decrease one by one along the arranging orientation. Two adjacent double-pole permanent magnets 6 on the same side have opposite polarities. Magnetic yoke 5 is used as the magnetic conducting path for respective magnetic pole of the plurality of the double-pole permanent magnets 6 oriented to an axial center. The main magnetic circuit passes therethrough. A magnetic field distribution which is weak-to-strong or strong-to-weak along a magnet arranging orientation is generated on the external main magnetic circuit of the magnetic combination unit. 3, The magnetic combination unit includes multi-pole permanent magnet 3 and magnetic yoke 5. The multi-pole permanent. magnet 3 is divided into a plurality of magnet units 11 that have opposite polarities. The surface magnetic fluxes of the plurality of the magnet units 11 increase or decrease one by one along the arranging orientation. Adjacent magnet units 11 on the same side have opposite polarities. The magnetic yoke 5 is used as the magnetic conducting path for respective magnetic pole of the multi-pole permanent magnet 3 oriented to the axial center. The main magnetic circuit passes therethrough. A magnetic field distribution which is weak-to-strong or strong-to-weak along a magnet arranging orientation is generated on the external main magnetic circuit of the magnetic combination unit. Magnetic yoke 5 is one of soft iron or magnetic steel or magnetically soft alloy or ferrite material. Magnetic yoke 5 is used as the magnetic conducting path for respective magnetic pole of the multi-pole permanent magnet 3 oriented to an axial center. The main magnetic circuit passes therethrough. A magnetic field distribution which is weak-to-strong or strong-to-weak along a magnet arranging orientation is generated on the external main magnetic circuit of the magnetic combination unit. There can be a plurality sets of magnetic combination units. Some of the magnetic combination units include one or more double-pole permanent magnets 6 and magnetic yoke 5. Remaining magnetic combination units include multi-pole permanent magnet 3 and magnetic yoke 5. The plurality sets of magnetic combination units share the same the magnetic yoke 5. Thus, a part of the main magnetic circuit of the magnetic combination unit is inside the multi-pole permanent magnet 3 and magnetic yoke 5, and a part of the main magnetic circuit passes through key casing 2 entering the external space. The main magnetic field of the magmatic combination unit has an oriented distribution in the external space.

According to the convenience of manufacture, the third technical solution is described in detail hereinafter. Take the four-pole permanent magnet as an example, the magnetic combination unit includes one magnet unit 11 with a large surface flux and one magnet unit 11 with a small surface flux. When the multi-pole permanent magnet 3 is expanded into six-pole, the multi-pole permanent magnet 3 includes one magnet unit 11 with a large surface flux, one magnet unit 11 with a middle surface flux, and one magnet unit 11 with a small surface flux that are arranged in sequence. Such design can generate a magnetic field distribution which is weak-to-strong or strong-to-weak along the magnetic steel arranging orientation on the main magnetic circuit outside the magnetic combination unit. Magnet units 11 are made of the same material, having the same intensity of magnetization. The magnets with different surface fluxes are made by altering the area of the cylindrical surface which is perpendicular to the magnetic field.

When the magnetic encoding key is inserted into the magnetic encoding lock core and reaches the unlocking position, each set of magnetic combination unit of the magnetic unlocking mechanism in the magnetic encoding key respectively corresponds to one free monad moving cavity in the magnetic encoding lock core in terms of the spatial position one-by-one. The externally oriented distribution of the main magnetic field of the magnetic combination unit is directly oriented to the free monad moving cavity. Thus, the magnetic combination unit and the free monad located inside the free monad moving cavity, which includes big monad 107 and small monad 108, form a flux linkage which has a short magnetic circuit. Further, the free monad is attracted to a position with the shortest magnetic circuit—unlocking position.

The content described above is one embodiment of the present invention, which is not used to limit the scope of the present invention. Any equivalent alternatives or modifications according to the present invention are covered by the scope of the claims of the present invention.

What is claimed is:

1. A magnetic unlocking device of a magnetic encoding key, comprising:

a key casing, at least one set of magnetic combination unit and a filler located inside the key casing, wherein the magnetic combination unit includes a plurality of double-pole permanent magnets and a magnetic yoke, one magnetic pole of the plurality of double-pole permanent magnets being near to the magnetic yoke and another magnetic pole being far from the magnetic yoke;

wherein the plurality of double-pole permanent magnets are arranged in an increasing or decreasing order of surface magnetic fluxes along an arranging orientation;

wherein adjacent two double-pole permanent magnets on a same side have opposite polarities;

wherein the magnetic yoke is used as a magnetic conducting path for perspective magnetic pole of the plurality of double-pole permanent magnets oriented to an axial center;

wherein a butterfly-like magnetic field distribution is generated on an external main magnetic circuit of the magnetic combination unit.

2. The magnetic unlocking device of the magnetic encoding key of claim 1, wherein a magnetic field distribution which is weak-to-strong or strong-to-weak along the magnet arranging orientation is generated on an external main magnetic circuit of the magnetic combination unit.

3. The magnetic unlocking device of the magnetic encoding key of claim 2, wherein a plurality sets of the magnetic combination units are provided, wherein some of the magnetic combination units include single double-pole permanent magnet and the magnetic yoke, remaining magnetic combination units include a plurality of double-pole permanent magnets and the magnetic yoke, wherein the plurality sets of magnetic combination units share the same magnetic yoke.

4. The magnetic unlocking device of the magnetic encoding key of claim 1, wherein the magnetic yoke is one of soft iron, or magnetic steel, or magnetically soft alloy, or ferrite material.

5. The magnetic unlocking device of the magnetic encoding key of claim 1, wherein the filler is a magnetic conductor or a magnetic non-conductor.

6. A magnetic unlocking structure including the magnetic unlocking device of claim 1, wherein the magnetic unlocking structure further includes a lock core device, the magnetic unlocking device being inserted into the lock core device and fit the lock core device, wherein the lock core device includes a lock core casing, a lock knob, rotatably provided in an internal cavity of the lock core casing, a lock core front end cover and a lock core rear end cover, respectively located on both ends of the lock core casing, wherein an internal wall of the lock core casing is provided with at least one monad longitudinal moving groove and at least one monad horizontal rotating groove, wherein an end on the lock knob corresponding to the lock core front end cover along an axis line is provided with an unlocking hole of the magnetic encoding key, wherein an external wall of the lock knob is provided with a plurality of monad longitudinal slide-ways, wherein at least one of the plurality of monad longitudinal slide-ways are provided with a free monad, the free monad being big monad and/or small monad, the monad longitudinal slide-way and the monad longitudinal moving groove corresponding to each other and forming a monad moving cavity, wherein when unlocking, the magnetic combination unit and each free monad moving cavity correspond to each other in terms of positions, the main magnetic field of the magnetic combination unit being distributed externally and directly oriented to the free monad moving cavity, wherein an arranging direction of a magnetic field in the magnetic combination unit is the same as a moving direction of the free monad of the free monad moving cavity, wherein the magnetic combination unit can attract one or more free monads that are located at a weak magnetic field side of the magnetic combination unit to a position which has a shortest magnetic circuit to the magnetic combination unit and a strongest magnetic field.

7. A magnetic unlocking device of a magnetic encoding key, comprising:

a key casing;

at least one set of magnetic combination unit and a filler located inside the key casing;

wherein the magnetic combination unit includes a multi-pole permanent magnet and a magnetic yoke, wherein the multi-pole permanent magnet is divided into a plurality of magnet units having opposite polarities, wherein the plurality of magnet units are arranged in an increasing or decreasing order of surface magnetic fluxes along an arranging orientation, adjacent magnet units on the same side have opposite polarities, wherein the magnetic yoke is used as a magnetic conducting path for perspective magnetic pole of the multi-pole permanent magnet oriented to an axial center, the main magnetic circuit passing therethrough, wherein a magnetic field distribution which is weak-to-strong or strong-to-weak along a magnet arranging orientation is generated on external main magnetic circuit of the magnetic combination unit.

8. The magnetic unlocking device of the magnetic encoding key of claim 7, wherein a plurality sets of the magnetic combination units are provided, the plurality sets of magnetic combination units share the same magnetic yoke.

9. A magnetic unlocking structure including the magnetic unlocking device of claim 7, wherein the magnetic unlocking structure further includes a lock core device, the magnetic unlocking device being inserted into the lock core device and fit the lock core device, wherein the lock core device includes a lock core casing, a lock knob, rotatably provided in an internal cavity of the lock core casing, a lock core front end cover and a lock core rear end cover, respectively located on both ends of the lock core casing, wherein an internal wall of the lock core casing is provided with at least one monad longitudinal moving groove and at least one monad horizontal rotating groove, wherein an end of the lock knob corresponding to the lock core front end cover along an axis line is provided with an unlocking hole of the magnetic encoding key, wherein an external wall of the lock knob is provided with a plurality of monad longitudinal slide-ways, wherein at least one of the plurality of monad longitudinal slide-ways are provided with a free monad, the free monad includes big monad and small monad, the monad longitudinal slide-way and the monad longitudinal moving groove corresponding to each other and forming a monad moving cavity, wherein when unlocking, the magnetic combination unit and each free monad moving cavity correspond to each other in terms of positions, the main magnetic field of the magnetic combination unit being distributed externally and directly oriented to the free monad moving cavity, wherein an arranging direction of a magnetic field in the magnetic combination unit is the same as a moving direction of the free monad of the free monad moving cavity, wherein the magnetic combination unit can attract one or more free monads that are located at a weak magnetic field side of the magnetic combination unit to a position which has a shortest magnetic circuit to the magnetic combination unit and a strongest magnetic field.

* * * * *